US008469193B2

(12) United States Patent
Lamstein

(10) Patent No.: US 8,469,193 B2
(45) Date of Patent: Jun. 25, 2013

(54) VACUUM ACTIVATED SHIPPING CONTAINER

(75) Inventor: Aaron Lamstein, San Rafael, CA (US)

(73) Assignee: Worldwise, Inc., San Rafael, CA (US)

( * ) Notice: Subject to any disclaimer, the term of this patent is extended or adjusted under 35 U.S.C. 154(b) by 1912 days.

(21) Appl. No.: 11/022,198

(22) Filed: Dec. 23, 2004

(65) Prior Publication Data

US 2006/0138013 A1 Jun. 29, 2006

(51) Int. Cl.
*B65D 81/20* (2006.01)

(52) U.S. Cl.
USPC ..... 206/524.8

(58) Field of Classification Search
USPC ..... 206/524.8, 497, 484; 383/44, 119, 383/120; 220/9.4, 495.01, 495.03
See application file for complete search history.

(56) References Cited

U.S. PATENT DOCUMENTS 3,610,455 A * 10/1971 Greenhalgh et al. ..... 215/12.1
3,948,436 A * 4/1976 Bambara ..... 206/523
4,403,695 A * 9/1983 Raymoure et al. ..... 206/497
4,702,376 A * 10/1987 Pagliaro ..... 206/524.8
5,009,318 A * 4/1991 Lepinoy ..... 206/524.8
5,246,114 A * 9/1993 Underwood ..... 206/524.8
5,620,098 A * 4/1997 Boos et al. ..... 206/525
6,102,569 A * 8/2000 Wang ..... 383/104
6,334,710 B1 * 1/2002 Kuge et al. ..... 383/104
6,767,509 B1 * 7/2004 Griesbach et al. ..... 422/29
2001/0000480 A1 * 4/2001 Stagg et al. ..... 428/43
2001/0021282 A1 * 9/2001 Hanson ..... 383/120
2002/0162767 A1 * 11/2002 Ohtsubo ..... 206/524.8
2003/0002755 A1 * 1/2003 Kim et al. ..... 383/119
2003/0141976 A1 * 7/2003 Dickinson et al. ..... 340/572.8

* cited by examiner

*Primary Examiner* — Mickey Yu
*Assistant Examiner* — Rafael Ortiz
(74) *Attorney, Agent, or Firm* — Bay Area Technology Law Group PC

(57) ABSTRACT

A shipping container and method of use. The shipping container is intended to contain bulky, compressible objects under vacuum in order to reduce the bulk size of these contents during shipping. The shipping container is configured as a plastic body sized to receive and envelop the bulky, compressible contents and includes a top, a bottom, each of which is characterized as having a periphery, and side walls, the latter of which are compressible. A stem is provided passing through the plastic body for passage of air and for selective sealing after the air has passed therethrough. The top, bottom and side walls are preferably transparent and are of the sufficient thickness and durability to enable the shipping container to be shipped between remote locations without any protective packaging being applied thereto while substantially resisting damage to the shipping container and its contents.

1 Claim, 2 Drawing Sheets

VACUUM ACTIVATED SHIPPING CONTAINER

TECHNICAL FIELD

The present invention involves a shipping container in which the container's contents are under vacuum. By employing this invention, the bulk volume of a shipping container can be reduced resulting in significant cost savings.

BACKGROUND OF THE INVENTION

It has become increasingly apparent that as time goes on, manufacturing has shifted to remote locations where labor costs are less than those in this country. This is particularly true as it pertains to the manufacture of non-technical or relatively low end products which rely upon various unskilled but labor intensive operations. However, as manufacturing has shifted to off shore locations, shipping costs have become an increasingly more significant factor in establishing product pricing.

Typically, manufactured goods produced in Asia are imported into the United States on containerized vessels. These goods are not only manufactured but packaged at Asian factories and multiple units placed within cardboard containers or otherwise bundled in groups for placement within cargo containers which are, in turn, stacked atop appropriately configured vessels. The shipping cost per item is dictated by the number of such items which can be placed within such shipping containers as the cost per transoceanic passage substantially remains fixed.

Certain items, such as televisions, stereos, computers and semiconductor chips are configured with hard outer casings and there is little that a shipper can do to reduce shipping costs. In these instances, one would only try to maximize stacking efficiencies in order to take full advantage of shipping container volumes. However, the situation is considerably different for products such as pillows, blankets, bedding and plush novelty items which possess large volumes of air or otherwise compressible space. In those instances, shipping costs could be significantly reduced if the volumes of such products were reduced in order to enable a shipper to incorporate more unit items per container.

Vacuum packing has been available to a multitude of users varying from home consumers who wish to preserve food products to those wishing to store soft goods for long periods of time. In each instance, a plastic membrane is placed about an object and vacuum drawn in order to reduce internal volume by collapsing the plastic membrane onto its contents.

Although vacuum sealing in the creation of packaging for manufactured goods may have been contemplated by others, in each instance, these plastic enclosures have not been fabricated to act as their own shipping containers. Invariably, plastic enclosures, be they vacuum sealed or otherwise, are housed in outer protective enclosures, such as printed cardboard boxes in order to protect the inner plastic wrap from anticipated abuse incurred during shipping. This anticipated shipping damage is particularly of concern when dealing with vacuum sealed enclosures for a single puncture or abuse-induced breakage can cause a loss of internal vacuum resulting in potentially catastrophic consequences. A loss of internal vacuum could compromise the integrity of perishable goods while bulk items whose volumes have been reduced as a result of the application of suitable vacuum pressures could expand during shipping resulting in damage to the containerized vessel and adjacent packaged goods.

In addition to the above concerns, it is quite apparent that "double packaging" in terms of providing a vacuum creating shroud about an object which is then encased in an outer abuse-resistant shipping package adds yet a further cost which must be absorbed by the ultimate consumer.

It is thus an object of the present invention to provide vacuum packaging in order to reduce shipping volume and thus cost of a wide range of manufactured goods.

It is a further object of the present invention to provide vacuum packaging which can act both as a vacuum induced volume reducing shroud but also as a shipping container without the need for any external outer protective expedience.

These and other objects will be more readily appreciated when considering the following disclosure and appended claims.

SUMMARY OF THE INVENTION

The present invention is directed to a shipping container for shipping bulky, compressible contents under vacuum and at a reduced volume. The shipping container comprises a plastic body sized to receive and envelop its contents. The plastic body, itself, comprises a top, a bottom, each of which having a periphery, and side walls, the latter of which are compressible. A stem is provided through the plastic body for the passage of air and for selective sealing after air has passed therethrough. The top, bottom and side walls are of a sufficient thickness and durability as to enable the shipping container to be shipped between remote locations without any protective packaging being applied thereto while substantially resisting damage to the shipping container and its contents.

DETAILED DESCRIPTION OF THE INVENTION

Figure 1:
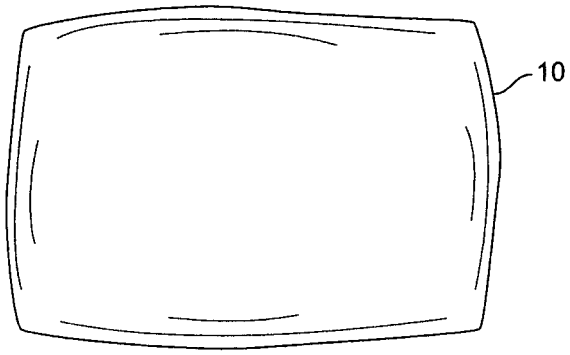
FIG. 1 is a side cross-sectional view of a typical object to be shipped employing the shipping container of the present invention.

As noted previously, the present invention is directed to a shipping container for shipping bulky, compressible contents under vacuum while substantially resisting damage to the shipping container and its contents. In this regard, reference is made to FIG. 1 which depicts a typical object in the form of pillow 10 whose shipment would greatly benefit from the practice of the present invention.

Figure 2:
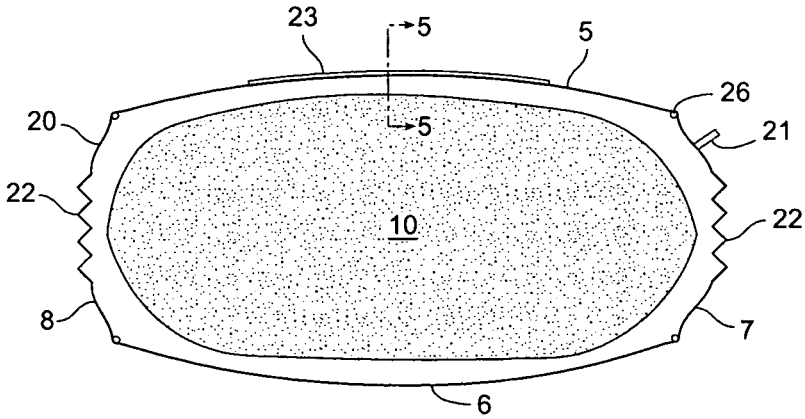
FIG. 2 is a side cross-sectional view of the object of FIG. 1 enclosed by the shipping container of the present invention prior to the application of a vacuum thereon.

Turning to FIG. 2, shipping container 20 is shown to embrace and fully envelope pillow 10. Shipping container 20 is comprised of a plastic body sized to receive and envelop pillow 10. The shipping container includes top 5 and bottom 6 each of which is characterized by having a periphery 31

Figure 3:
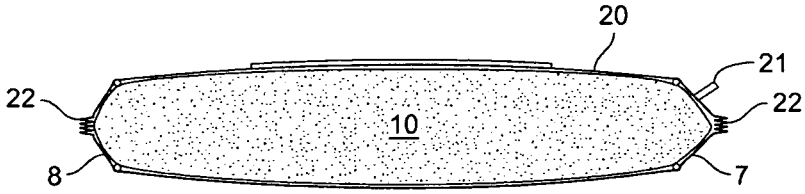
FIG. 3 is a side cross-sectional view of the shipping container and contents of FIG. 2 after the application of a vacuum thereupon.
Figure 7:
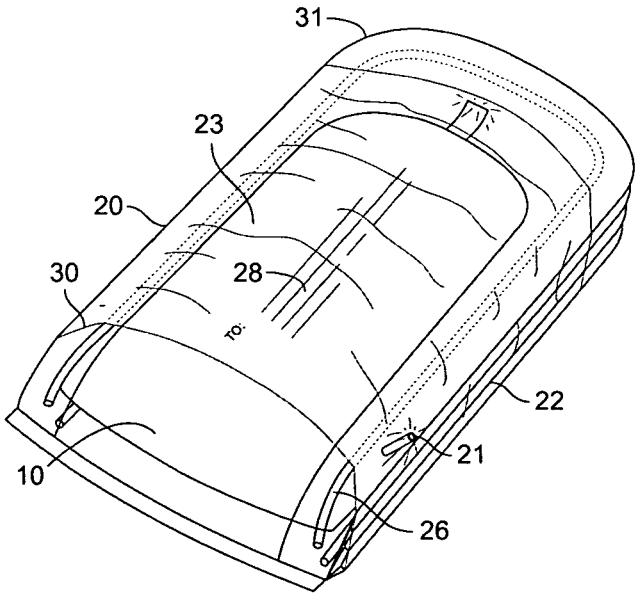
FIG. 7 is a prospective view of the present invention.

(FIG. 7). Side walls 7 and 8 are provided which are compressible. Ideally, side walls 7 and 8 are compressible through the use of folds 22 such that as a vacuum is applied to shipping container 20, the side walls are caused to collapse about compressible folds 22 resulting in a reduction of shipping container volume. In doing so, stem 21 is configured as passing through the plastic body of shipping container 20 for the passage of air and for selective sealing after a vacuum has been created resulting in a reduced volume as shown in FIG. 3. It is proposed that shipping container 20 be composed of a suitable plastic having a suitable thickness and flexibility to resist damage through shipment yet collapsible for use herein.

As a further preferred embodiment, it is contemplated that at least a portion of shipping container 20, and preferably its top 5 be substantially transparent. As noted by reference to FIG. 7, shipping information such as addressee information 28 could be placed atop pillow 10 and thus be visible through top 5 thus obviating the need for further outer packing. As an alternative, addressing information could be printed directly upon top 5 in order to accomplish this same function.

As previously noted, it has been determined that a reduction in shipping container volume, in passing between the iterations shown in FIGS. 2 and 3 that at least one compressible fold 22 be configured within each side wall 7 and 8. As air is drawn through stem 21 folds 22 provide an accordion-like collapse thus reducing the internal volume of shipping container 20. This has been found to be the most appropriate expedient in practicing the present invention for the enhanced thickness of plastic constituting top 5, bottom 6 and side walls 7 and 8 make these elements resistant to compression while performing their resistance to damage characteristic functions inherent in producing suitable protective packaging necessitated by the use of the present invention as a shipping container.

To further make the present invention more resistant to shipping damage, it is proposed, as a preferred embodiment, reinforcement be applied to strategic portions of shipping container 20. For example, strands 26 can be molded at the peripheries 31 of top 5 and bottom 6 as shown in various cross-sectional views as well as in the respective view of FIG. 7. The strands of either reinforced plastic fiber or metal wire or rods could be molded within shipping container 20 during its manufacture. The shape and integrity of shipping container 20 would thus be enhanced.

As a further expedient which can be used in conjunction with strands 26 or as an alternative thereto, it is contemplated that container 20 be provided with reinforced corner portions 35 as it is anticipated that, during shipment, the abuse inflicted upon shipping container 20 is likely to be manifested at the corners where top 5 and bottom 6 join side walls 7 and 8.

Figure 4:
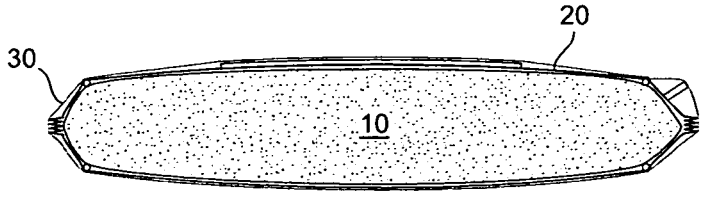
FIG. 4 is a side cross-sectional view of the combination of FIG. 3 further showing the use of an outer shrink wrap membrane.

It is recognized that when subjected to extreme abuse, any shipping container, including container 20 could be ruptured thus compromising the vacuum created therein resulting in an expanded volume imposed upon shipping container 20 by pillow 10. As a further expedient, it is proposed that shipping container 20, once placed under vacuum in its reduced volumetric state as shown in FIGS. 3, 4, and 7 be enveloped in at least one layer of shrink wrap 30 encompassing portions of top 5 and bottom 6. In doing so, in the event that vacuum is lost within the interior of shipping container 20, shrink wrap 30 will resist expansion of the shipping container thus providing an additional level of safety in proceeding with the shipping process.

Figure 5A:
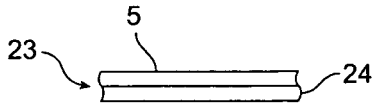
FIGS. 5*a* and 5*b* show alternative embodiments of the present invention taken along cross-section 5-5 of FIG. 2.
Figure 5B:
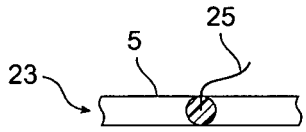
Figure 6:
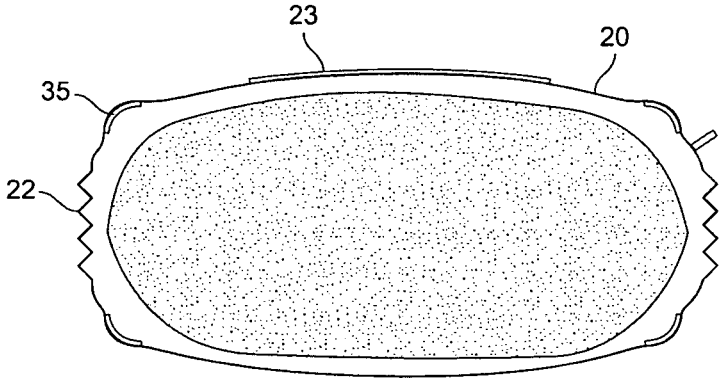
FIG. 6 is a side cross-sectional view of the present invention depicting a preferred embodiment applied thereto.

Once the shipping process has been completed and a consumer wishes to access the interior of shipping container 20 in order to remove pillow 10, several alternative expedients can be employed. In referring to FIG. 5*a*, a thickened reinforcing member 24 such as thickened plastic or penetration resistant cardboard could be bonded to the interior of top 5 along panel 23 (FIG. 7). In doing so, if a consumer was to open top 5 using a box cutter or similar knife blade, top 5 could be severed while reinforcing layer 24 would prevent the blade from physically contacting pillow 10. Alternatively, as shown in FIG. 5*b*, ripcord 25 could be configured within top 5 during manufacture. A consumer would be provided a pigtail at one end of ripcord 25 to enable the ripcord to be securely grabbed and pulled thus severing top 5 in the process. Pillow 10 could then be removed from shipping container 20.

Various embodiments and iterations of the shipping container have been described above. Other modifications and embodiments will suggest themselves to those of ordinary skill in the art. Thus, it is intended that this invention be limited solely by the scope of the allowed claims.

The invention claimed is:

1. A shipping container for shipping bulky, compressible contents under vacuum and at reduced volume, said shipping container comprising a plastic body sized to receive and envelop said contents, said plastic body comprising a top, a bottom, each of which having a periphery and side walls, the latter of which are compressible, a stem passing through said plastic body for the passage of air and for selective sealing after said air has passed therethrough, said top, bottom and side walls being of sufficient thickness and durability as to enable said shipping container to be shipped between remote locations without any protective packaging being applied thereto while substantially resisting damage to said shipping container and its contents, and a rip cord configured within said plastic body for selectively opening said plastic body to access said contents.

* * * * *